US009565979B2

(12) United States Patent
Maclaine et al.

(10) Patent No.: US 9,565,979 B2
(45) **Date of Patent: *Feb. 14, 2017**

(54) HAND DRYING

(75) Inventors: Alasdair Michael Maclaine, London (GB); Peter David Gammack, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 102 days.

This patent is subject to a terminal disclaimer.

(21) Appl. No.: 14/407,924

(22) PCT Filed: Jun. 14, 2012

(86) PCT No.: PCT/GB2012/051372

§ 371 (c)(1),
(2), (4) Date: Feb. 12, 2015

(87) PCT Pub. No.: WO2013/186509

PCT Pub. Date: Dec. 19, 2013

(65) Prior Publication Data

US 2015/0164287 A1 Jun. 18, 2015

(51) Int. Cl.
*F26B 21/04* (2006.01)
*A47K 10/00* (2006.01)
*A47K 10/48* (2006.01)

(52) U.S. Cl.
CPC ..... *A47K 10/00* (2013.01); *A47K 10/48* (2013.01); *A47K 2210/00* (2013.01)

(58) Field of Classification Search
CPC ..... F26B 19/00; F26B 21/00; F26B 21/04; E03C 1/00; E03C 1/01; A45D 20/00; A47K 10/00; A47K 10/48
(Continued)

(56) References Cited

U.S. PATENT DOCUMENTS 4,144,596 A 3/1979 MacFarlane et al.
4,295,233 A 10/1981 Hinkel et al.
(Continued)

FOREIGN PATENT DOCUMENTS

DE EP 2842870 A1 * 3/2015 ..... A47K 10/48
EP 2 177 142 4/2010
(Continued)

OTHER PUBLICATIONS

International Search Report and Written Opinion mailed Mar. 26, 2013, directed to International Application No. PCT/GB2012/051372; 10 pages.
(Continued)

*Primary Examiner* — Stephen M Gravini
(74) *Attorney, Agent, or Firm* — Morrison & Foerster LLP

(57) ABSTRACT

An arrangement incorporates a sink and a hand dryer which extends over the sink. The hand dryer is of the type which uses an air-knife mechanically to wipe the water from the user's hands. The hand dryer comprising two elongate air-knife discharge outlets—each outlet discharging a respective air-knife forwardly onto a hand of the user—the air-knife outlets being arranged side-by-side over the basin of the sink. Each air-knife outlet extends along a part of the hand dryer which is swept back at an angle such that the inboard end the air-knife outlet is in front of the outboard end of the air-knife outlet.

12 Claims, 8 Drawing Sheets

(58) Field of Classification Search
USPC ..... 34/90, 100, 201; 4/619, 623; 392/380, 392/385, 384; 8/149, 159; 134/56 R, 134/102.3
See application file for complete search history.

(56) References Cited

U.S. PATENT DOCUMENTS

| | | | | |
|---|---|---|---|---|
| 4,398,310 | A | 8/1983 | Lienhard | |
| 5,074,322 | A | 12/1991 | Jaw | |
| 5,522,411 | A | 6/1996 | Johnson | |
| 5,727,579 | A | 3/1998 | Chardack | |
| 7,614,160 | B2 | 11/2009 | Kameishi et al. | |
| 7,971,368 | B2 | 7/2011 | Fukaya et al. | |
| 8,155,508 | B2 | 4/2012 | Caine et al. | |
| 8,296,875 | B2 * | 10/2012 | Loberger | E03C 1/057 4/623 |
| 8,381,329 | B2 | 2/2013 | Bayley et al. | |
| 8,572,772 | B2 | 11/2013 | Wolf et al. | |
| 8,950,019 | B2 | 2/2015 | Loberger et al. | |
| 8,997,271 | B2 * | 4/2015 | Bayley | A47K 10/48 4/638 |
| 2004/0128755 | A1 * | 7/2004 | Loberger | E03C 1/14 4/642 |
| 2009/0000142 | A1 | 1/2009 | Churchill et al. | |
| 2009/0293192 | A1 | 12/2009 | Pons | |
| 2012/0017459 | A1 | 1/2012 | Kikuchi et al. | |
| 2013/0340272 | A1 | 12/2013 | Courtney et al. | |
| 2015/0135429 | A1 * | 5/2015 | Dyson | A47K 10/48 4/678 |
| 2015/0164288 | A1 | 6/2015 | Courtney | |
| 2015/0164289 | A1 | 6/2015 | Courtney | |

FOREIGN PATENT DOCUMENTS

| | | | | |
|---|---|---|---|---|
| EP | 2 399 497 | | 12/2011 | |
| EP | 2 861 115 | | 4/2015 | |
| GB | 2 456 937 | | 8/2009 | |
| GB | WO 2013186507 | A1 * | 12/2013 | A47K 10/48 |
| IE | WO 2012076521 | A1 * | 6/2012 | A47K 10/48 |
| JP | 2002-136448 | | 5/2002 | |
| JP | 2004-261510 | | 9/2004 | |
| JP | 2006-304926 | | 11/2006 | |
| JP | 2008-5883 | | 1/2008 | |
| JP | 2009-523047 | | 6/2009 | |
| KR | WO 03024291 | A1 * | 3/2003 | A47K 10/48 |
| KR | 10-0909730 | | 7/2009 | |
| WO | WO-2009/039290 | | 3/2009 | |
| WO | WO-2010/088975 | | 8/2010 | |
| WO | WO-2010/095251 | | 8/2010 | |
| WO | WO-2011/074018 | | 6/2011 | |
| WO | WO-2013/186508 | | 12/2013 | |
| WO | WO-2013/186510 | | 12/2013 | |

OTHER PUBLICATIONS

Mitsubishi Electric Corporation. (Aug. 2009). *Jet Towel: Hand-drying for the 21st century,* Gifu, Japan; 8 pages.
Courtney, U.S. Office Action mailed Jul. 14, 2016, directed to U.S. Appl. No. 14/407,930; 8 pages.

* cited by examiner

HAND DRYING

REFERENCE TO RELATED APPLICATIONS

This application is a national stage application under 35 USC 371 of International Application No. PCT/GB2012/051372, filed Jun. 14, 2012, the entire contents of which are incorporated herein by reference.

FIELD OF THE INVENTION

The present invention relates generally to the field of hand drying, and in particular to arrangements which use an air-knife to dry the hands.

BACKGROUND OF THE INVENTION

In commercial washrooms, it is common to provide one or more sinks or water basins for washing, and one or more separate, wall-mounted hand-dryers which users can then use to dry their hands.

There are three distinct types of hand dryer on the market: "warm-air" hand dryers, "high speed" hand dryers and "air-knife" hand dryers.

Warm air hand dryers are very well known. They are invariably low flow, low speed machines which rely on heating the air to promote an evaporative drying effect at the surface of the hand. Examples include the Model A Series of hand dryers manufactured and marketed by World Dryer Corporation. The heated airflow is typically discharged through a single nozzle and the drying action is a "hand-over-hand" action, requiring the user to rub the hands together under the nozzle with the aim of encouraging the evaporative drying effect.

High speed hand dryers, as the name suggests, use high speed airflow (>80 m/s) to provide a momentum-drying effect at the surface of the hands. Examples include the Xlerator® hand dryer manufactured and marketed by Excel Dryer Inc. Again the airflow is typically discharged through a single relatively large nozzle and the mode of use is somewhat similar to the "hand-over-hand" action of the warm air dryer, with the hands being held or cupped together underneath the nozzle to dry them. However, instead of being evaporated, the vast majority of the water on the surface of the hands is instead driven or blasted from the hands by the high-momentum airflow, with evaporation accounting for only a small proportion of water removal. The airflow tends not to be heated, though waste heat from the motor may in some cases be used to heat the airflow to a degree.

The third general type of hand dryer is the air-knife hand dryer, examples of which include the Dyson Airblade range of Hand Dryers manufactured by Dyson (UK) Limited and the Jet Towel hand dryer manufactured by Mitsubishi Electric Corporation These hand dryers use an air-knife—effectively a sheet or curtain of moving air—to remove the water from the user's hands. The mode of operation is analogous to the established use of air knives in industry to remove debris or liquid from the surface of a product (see e.g. EP2394123A1, which describes removal of debris from a glass sheet using air knives): the air-knife moves across the surface of the hand and, as it does so, wipes or scrapes the water from the surface of the hand.

In both the Dyson Airblade and the Mitsubishi Jet Towel, two opposing, stationary air-knives are used, one for each side of the user's hand. The hands are inserted between the air-knives and then withdrawn slowly to effect the required relative movement between the hands and the air knives.

In the Dyson arrangement—shown in FIG. 1—the air knives are discharged through narrow, continuous slots (only the rear slot a is visible in FIG. 1), each less than 1 mm wide. In the Mitsubishi arrangement—shown in FIG. 2—the air-knife is instead discharged through opposing rows of individual discharge apertures (only the rear row b is visible in FIG. 2): here, the individual jets combine to produce the air knife downstream of the discharge apertures. In each case, the air knife is discharged at high speed (>80 m/s) to provide for an efficient wiping action across the surface of the hand.

SUMMARY OF THE INVENTION

The present invention is concerned with air-knife hand dryers.

According to the present invention, there is provided an arrangement comprising a sink and a hand dryer which extends over the sink, the hand dryer being of the type which uses an air-knife mechanically to wipe the water from the user's hands, the hand dryer comprising two elongate air-knife discharge outlets—each outlet being connected to an air supply and discharging a respective air-knife forwards onto a hand of the user—the air-knife outlets being arranged side-by-side over the basin of the sink, each air-knife outlet extending along part of the hand dryer which is arranged on an angle such that the inboard end of each air-knife outlet is in front of the outboard end of the air-knife outlet.

One of the problems identified with air-knife dryers is that of managing the disposal of waste water. This is a particular problem for air-knife dryers because the nature of the air-knife drying mechanism means that the water removal is non-evaporative: instead, the water is driven from the hands by the relatively high momentum of the airflow. In the conventional air-knife dryer arrangements described above, the waste water removed from the hands may be collected in a drip tray—which must periodically be emptied—or else is not collected at all and instead simply allowed to evaporate from surfaces on and around the dryer. Neither scheme is particularly hygienic.

The invention advantageously makes use of the existing mains drainage system to manage the waste water more effectively: by incorporating the air-knife dryer on a fixture for a sink so that water driven from the hands can simply drain to mains through the standard drain-hole in the basin of the sink.

The hand dryer does not rely on a two-sided drying action: opposing nozzles are not used to dry both sides of the hand simultaneously. Instead, the air-knife outlets are arranged side-by-side for drying ones side of the user's hands at a time. This is advantageous, because the use of opposing nozzles on conventional two-sided hand dryers imposes size restrictions: sufficient gap must be provided between the opposing nozzles to admit the hands, for example. By removing this size restriction, the hand dryer can be made more compact, so as not to interfere too much with the use of the sink for performing other tasks, such as washing.

At the same time, the dryer of the present invention advantageously dries a user's individual hands separately, using an air-knife action. In normal use, the user 'dips' his (or her) hands lengthwise in front of the air-knife outlets, first with the palm facing the nozzle sections and then—after reversing the hands—with the back of the hands facing the nozzle sections (or vice versa). There is no requirement in normal use to rub the hands together in the vein of the "hand-over-hand" drying method used on some conventional dryers: indeed, this is actively discouraged by the provision of two air-knife outlets.

Each air-knife outlet extends along a part of the hand dryer which is swept back at an angle such that the inboard end of the air-knife outlet is in front of the outboard end of the air-knife outlet. This "V-shaped" configuration makes the action of using the dryer comfortable for the user, but still allows the user to hold his hands in close proximity to the air knife outlets, which is critical for optimizing air-knife drying performance.

The swept-back parts of the hand dryer may additionally extend downwardly at an anhedral angle, so that the inboard end of each air-knife outlet is above the outboard end of the air-knife outlet. This has been found to provide additional comfort for the user in use.

In an arrangement which has been found particularly comfortable to use, the sweep angle is in the range 15-25° and the anhedral angle is in the range 10-20°. The preferred combination is a sweep angle of 21-24° and an anhedral angle of 13-15°.

Each air-knife outlet may comprise an elongate discharge aperture or elongate line of discharge apertures. For example, each air-knife outlet may be in the form of an elongate air slot or plurality of elongate air slots. Alternatively, an elongate line of round air holes may be used. The slot, or air holes, may be less than 2 mm wide, intended to provide a laminar, well-defined air knife with minimal wind shear.

The length of each elongate air-knife outlet is preferably greater than 80mm. This provides a good operational span across the width of a typical user's hands.

In accordance with another aspect of the invention, the arrangement additionally comprises a water faucet which extends over the sink and which delivers water for washing. Thus, the arrangement provides a single station both for washing and drying the hands: the user does not have to move between the sink and a separate hand dryer located somewhere else in the washroom.

The water faucet may have a water delivery nozzle—connected to a water supply—which nozzle is positioned in-between the two air-knife outlets. This is a compact configuration, and the water nozzle also acts to define a notional divide between the air-knife outlets, which encourages correct usage by encouraging the user to separate his hands rather than holding them together to dry them.

In a particularly compact configuration, the water delivery nozzle and air-knife discharge outlets are all provided on a single fixture which can be fitted next to the basin of the sink, with the water delivery nozzle and air-knife discharge outlets each being provided on a projecting part of the fixture, which extends over the basin of the sink. This projecting part may be a common projecting part, in the form of a spout. The water delivery nozzle may be connected through the spout to the water supply.

Likewise, the air-knife outlets may be connected through the spout to the air supply. The swept back parts of the hand dryer may be branch ducts which branch off from a main air supply duct inside the spout.

BRIEF DESCRIPTION OF THE DRAWINGS

Embodiments of the invention will now be described, with reference to the accompanying drawings, in which.

DETAILED DESCRIPTION OF THE INVENTION

Figure 1:
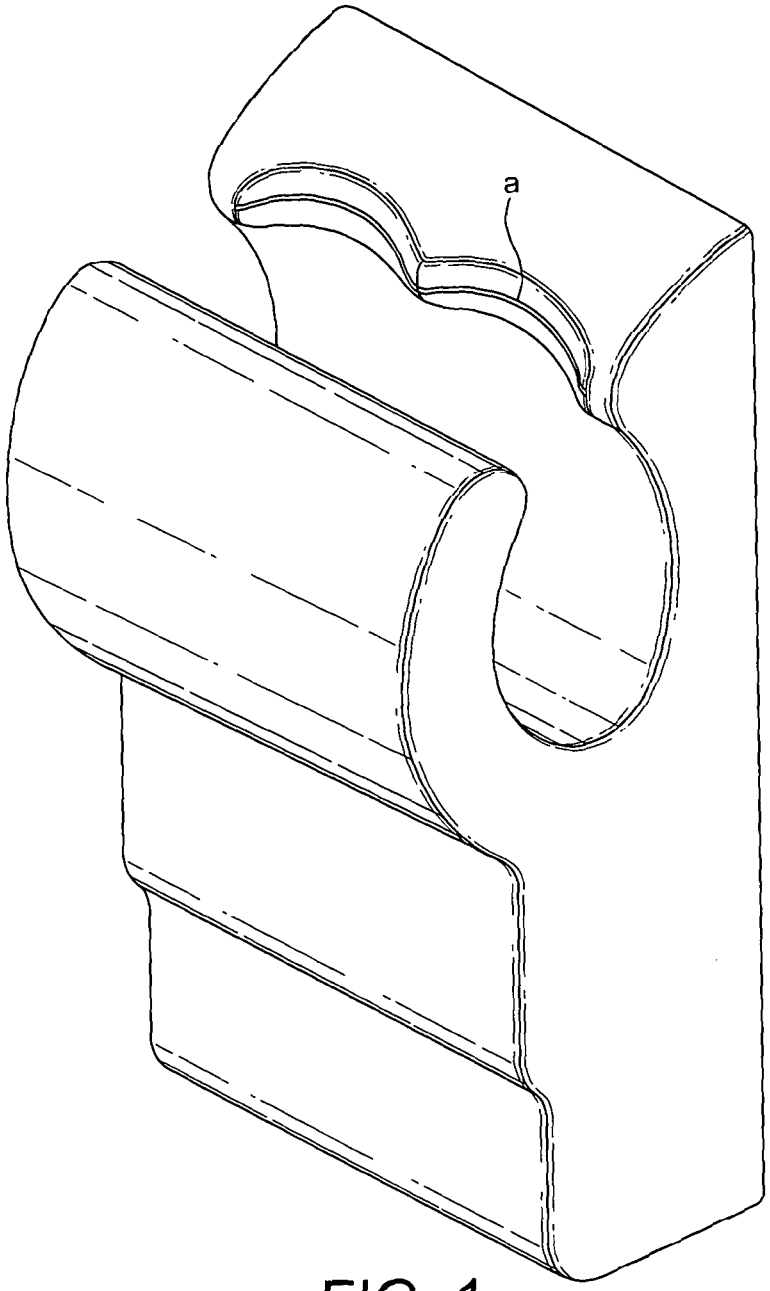
FIG. 1 (PRIOR ART)
FIGS. 1 and 2 are simplified perspective views of conventional air-knife hand dryers.

FIGS. 3-6 show an arrangement comprising a fixture 1 in combination with a sink 3.

The sink 3 itself may be conventional. A "Belfast-type" sink is shown, though other types of sink may alternatively be used. The sink 3 has a standard drain-hole 3*a*, in this case positioned towards the rear wall of the basin 3*b* of the sink 3.

The fixture 1 is fitted next to the basin 3*b* of the sink 3 using a locknut 5 underneath the sink 3 which engages with an externally threaded, hollow fixing stud 7 to clamp the fixture 1 in place (the fixture 1 may alternatively be fitted adjacent the sink rather than to the sink itself, according to the style of sink).

The fixture 1 has a tubular construction comprising a vertical, tubular trunk 9 which sits next to the basin 3*b* of the sink 3 and a projecting part, in the form of a spout 11, which projects horizontally from the trunk 9, out over the basin 3*b* of the sink 3. The fixture 1 is formed from metal: for example from conventional rolled steel tubing sections which are then welded together.

A downward facing water nozzle 13 is provided at the end of the spout 11. On demand, water for washing is supplied through the water nozzle 13 from a main supply line (not shown), via a water supply pipe 15 which runs through the trunk 9 and the spout 11.

The fixture 1 is configured for "hands-free" operation to supply water, using a conventional sensor and control loop which automatically opens a stop valve in the supply line, in response to detection of a user's hands in a washing position. Alternatively, the fixture may be configured for manual operation to supply water.

In accordance with the invention, the fixture 1 incorporates a hand dryer of the type which uses an air-knife mechanically to wipe the water from a user's hand. Two air-knives are discharged in use: a first air-knife 17*c*, which is discharged through an air-knife outlet 17 on the left hand side of the spout and a second air-knife 19*c*, which is discharged through an air-knife outlet 19 on the right hand side of the spout. Each air-knife outlet 17, 19 takes the form of a narrow elongate slot—less than 2 mm wide—on a respective tubular branch duct 21 extending laterally from the spout 11.

The branch ducts 21 branch off from a main air duct 23 which runs through the spout 11 and the trunk 9. This air duct 23 is connected to the positive pressure (output) side of a motor-driven fan 25 via a flexible hose 27 which fluidly connects to the inside of the trunk 9 via the hollow fixing stud 7 (if the water supply pipe 15 runs through the fixing stud 7—effectively within the air supply line—then adequate provision will need to be made to route the pipe 15 to the exterior of the air supply line, for connection to the water supply line).

On demand, the fan 25 drives airflow through the air-knife outlets 17, 19 to generate the respective air-knives. The exit airspeed at the air-knife outlets 17, 19 exceeds 80 m/s, and is preferably above 150 m/s. This provides in each case a well-defined air-knife for effective drying of the hands.

The hand dryer is configured for "hands-free" operation using a conventional sensor and control loop, which automatically switches on the fan 25 in response to detection of a user's hands in a drying position (which should be distinguishable from the aforementioned washing position—which automatically activates the water supply). Alternatively, the hand dryer may be configured for manual operation.

Figure 7:
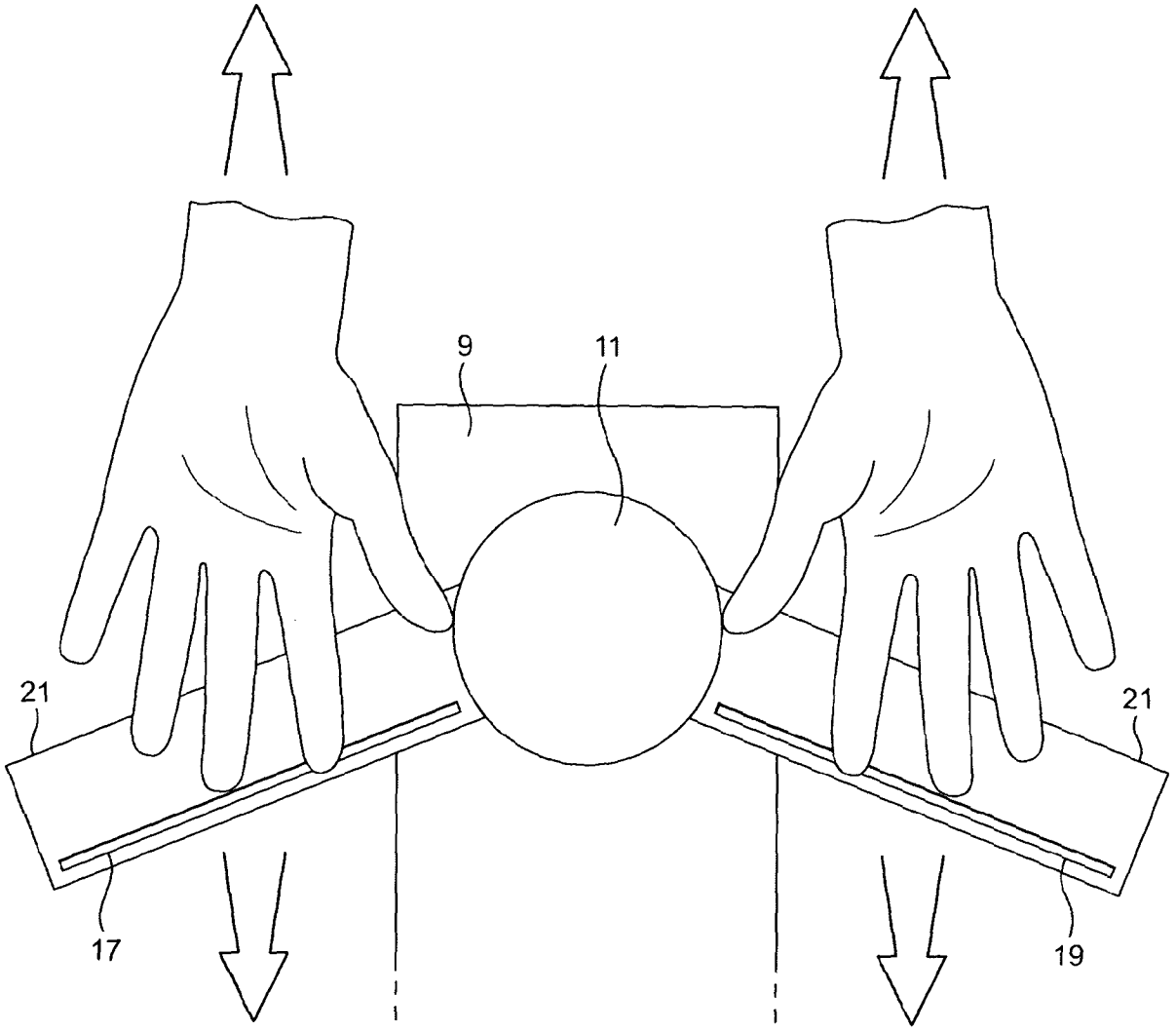
FIG. 7 is a front view of the fixture shown in FIG. 3, illustrating use of the fixture to dry the hands.

To commence the hand-drying operation, a user presents his (or her) wet left-hand—palm open—in front of the air-knife outlet 17 on the left hand side of the spout and similarly presents his wet right hand—palm open—in front of the air-knife outlet 19 on the right hand of the spout 11. The sensor and control loop then operates to activate the fan 25, which forces air under high pressure through the discharge apertures 17, 19: directing high-momentum airflow forwards onto the user's hands. The hands are dried one side at a time: first, the user passes his hands up and down in front of the air-knife outlets with the back of the hand facing the air-knife outlets (referred to below as the "standard pass"). This is shown in FIG. 7. Then—after turning over the hands—the user passes his (or her) hands up and down in front of the air-knife outlets with the palms facing the air-knife outlets (referred to below as the "reverse pass"). The "standard pass" and "reverse pass" may each be repeated, as required, and carried out in any order.

Figure 6:
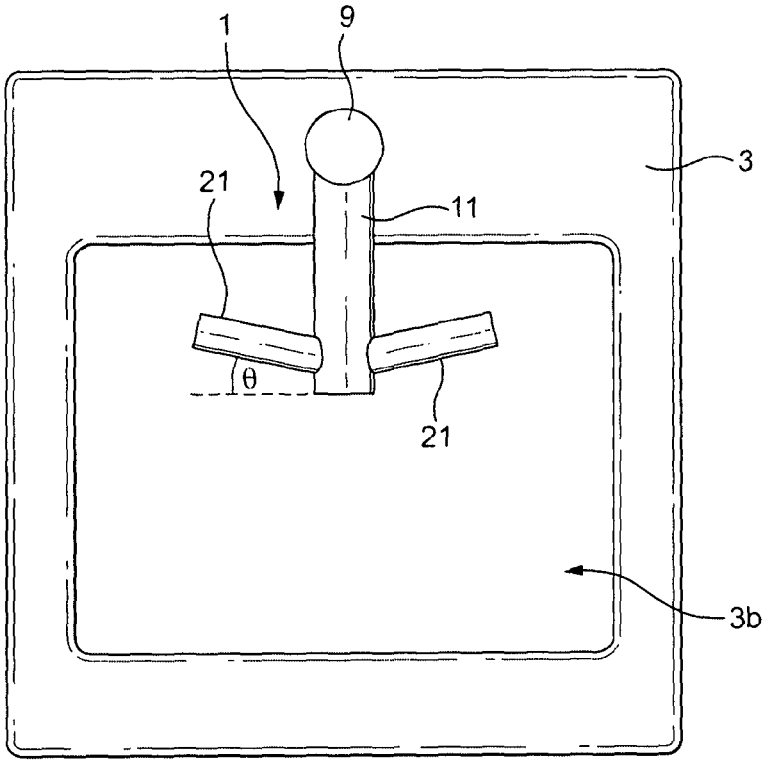
FIG. 6 is a plan view of the arrangement shown in FIG. 3.

The branch ducts 21 are swept back at a sweep angle, θ—shown in FIG. 6—such that the inboard end 17*a*, 19*a* of the air-knife outlets is in front of the respective outboard end 17*b*, 19*b* of the air-knife outlets. This improves user comfort—particularly during the reverse pass because it reduces the degree to which the user must supinate his hands and forearms in order to present the palm square-on to the air-knife outlets. The angle θ is in this case 22.5 degrees. A preferred range for θ is 10-50 degrees.

Figure 4:
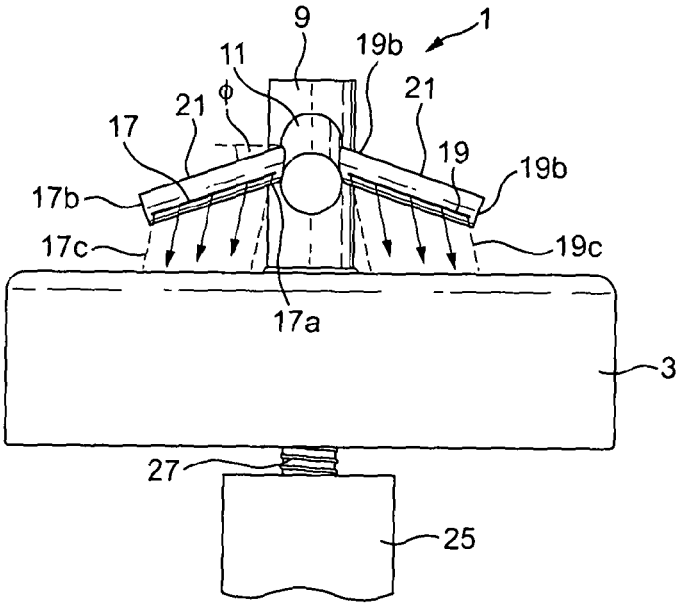
FIG. 4 is a front view of the arrangement shown in FIG. 3.
Figure 5:
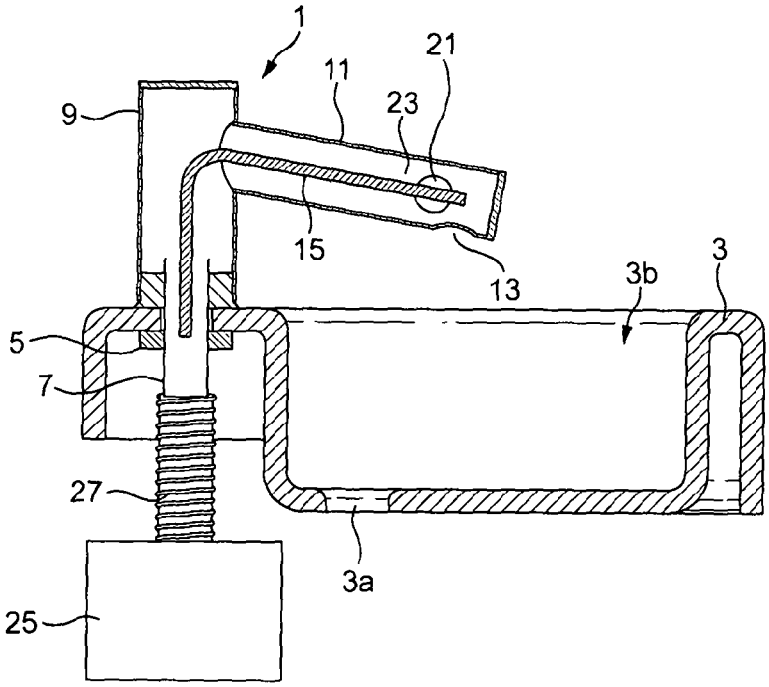
FIG. 5 is a section along A-A in FIG. 4.

The branch ducts also extend downwards at an anhedral angle, ϕ—shown in FIG. 4—such that the inboard end 17*a*, 19*a* of the air-knife outlets 17, 19 is above the respective outboard end 17*b*, 19*b* of the air-knife outlets. This also provides an ergonomic advantage in use, increasing user comfort particularly during the reverse pass. The angle ϕ is in this case 14 degrees. A preferred range for ϕ is 5 -25 degrees.

Figure 2:
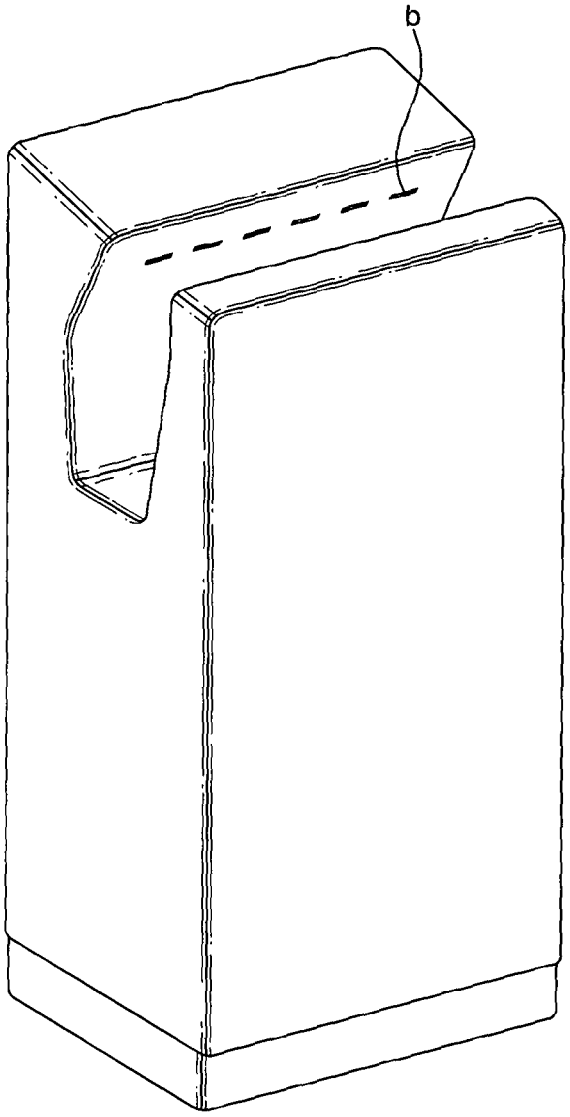
FIG. 2 (PRIOR ART)
Figure 3:
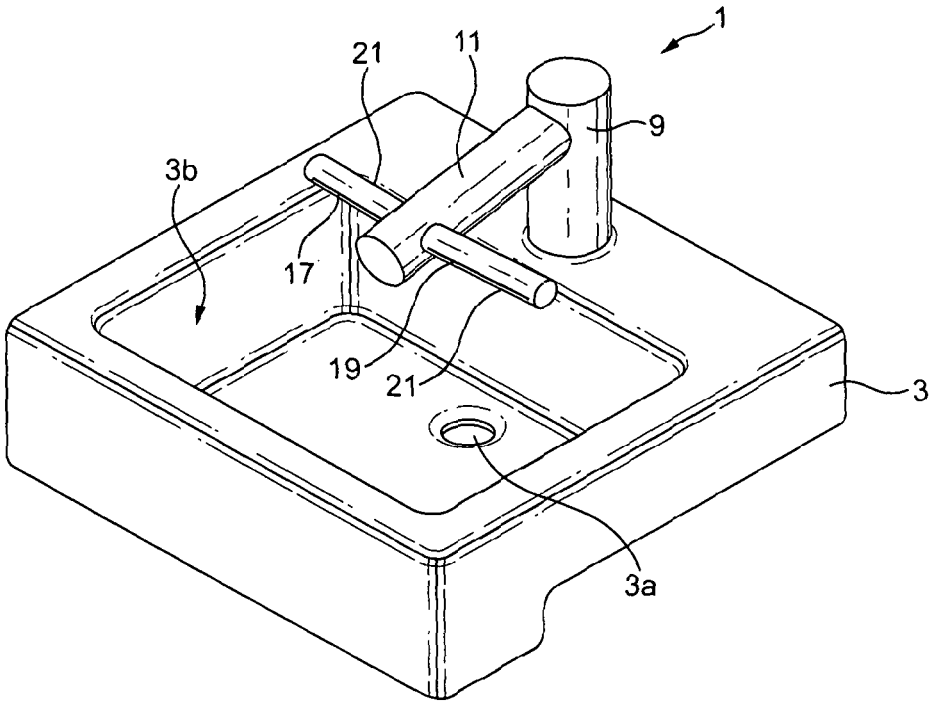
FIG. 3 is a perspective view of an arrangement in accordance with the invention, comprising a sink and a fixture fitted next to the basin of the sink.
Figure 8:
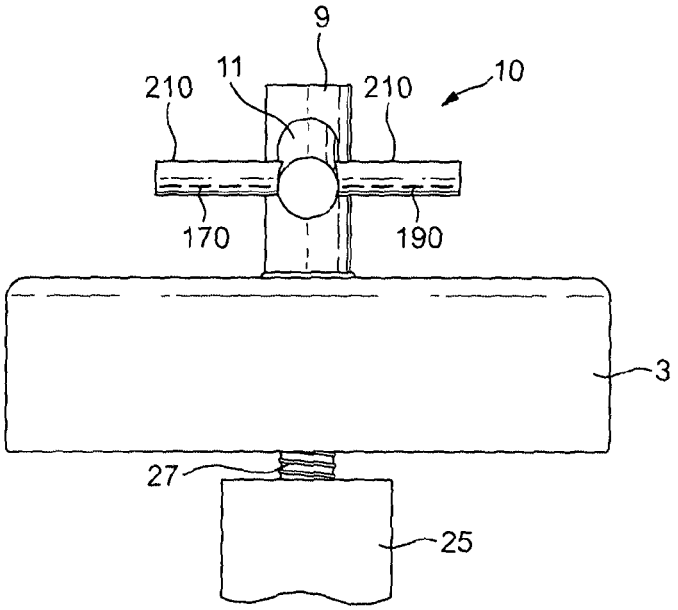
FIG. 8 is a front view of an alternative arrangement in accordance with the invention.
Figure 9:
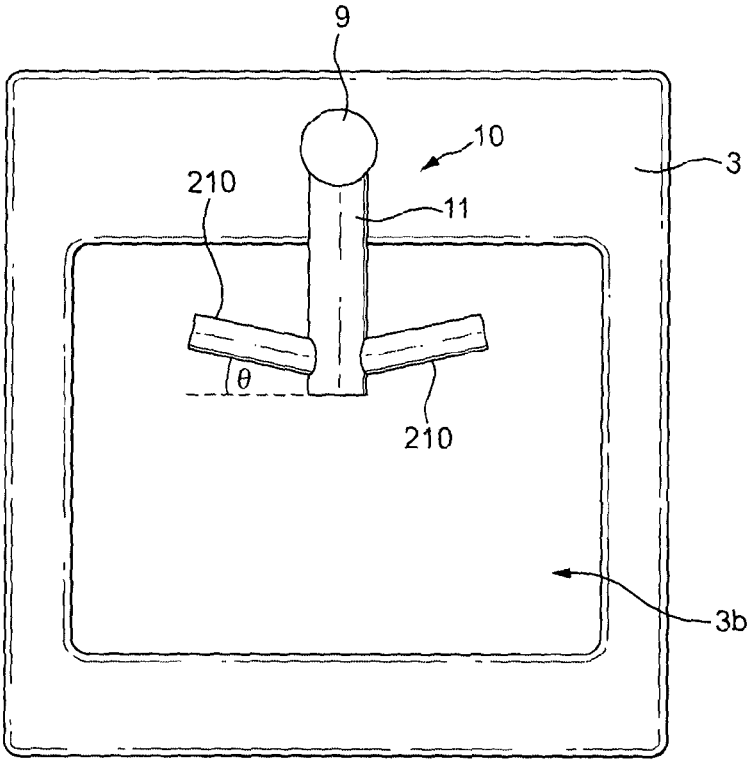
FIG. 9 is a plan view corresponding to FIG. 8.

Arranging the air-knife outlets so that they extend downwards at an anhedral angle is not an essential element of the invention. FIGS. 8 and 9 illustrates a 'neutral' configuration of a fixture 10, in which the branch ducts 210 extend horizontally from the spout 11. Here, the sweep angle, θ (FIG. 9) nevertheless aids user comfort in the manner described above. The air-knife outlets 170, 190 in this case take the form of respective elongate rows of shorter slots, rather than a single elongate slot—analogous to the Mitsubishi arrangement of slots in FIG. 2.

Figure 10:
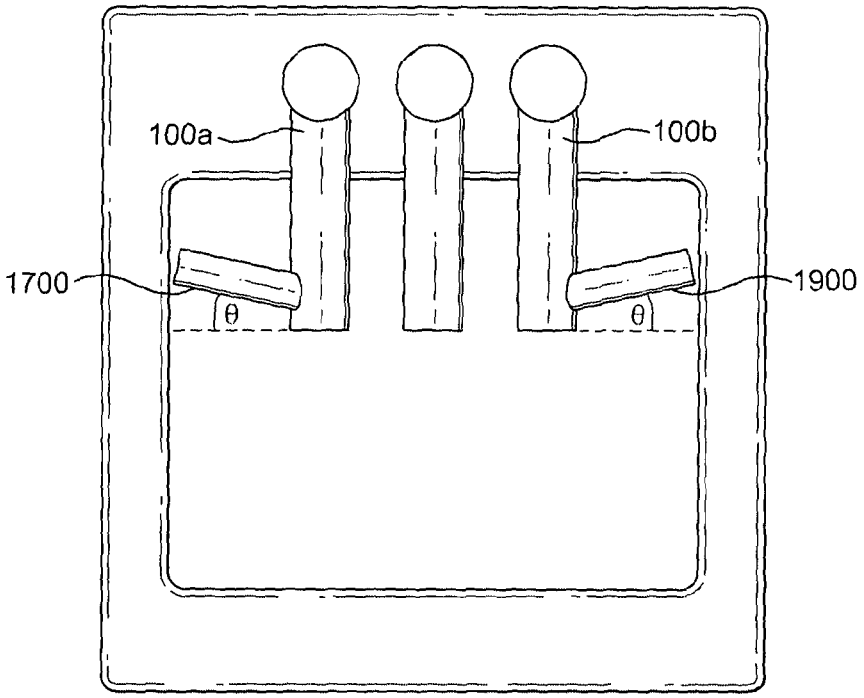
FIG. 10 is a plan view of an alternative arrangement in accordance with the invention, in which the air-knife outlets are provided on separate fixtures.

In the previous arrangements, a single fixture 1, 10 is provided which incorporates both the functions of a water faucet and a hand dryer. FIG. 10 shows an arrangement in which the air-knife outlets 1700, 1900 are instead located side by side on separate fixtures 100*a*, 100*b* fitted next to the basin 3*b* of the sink 3. The fixtures 100*a*, 100*b* are spaced apart from one another, so that the air-knife outlets 1700, 1900 are not positioned immediately side-by-side. This is in order to accommodate a separate, conventional water faucet 29 mounted centrally above the drain-hole in the sink basin 3*b*.

The invention claimed is:

1. An arrangement comprising a sink and a hand dryer which extends over the sink and a water faucet which extends over the sink, the hand dryer configured to use an air-knife mechanically to wipe the water from the user's hands, the hand dryer comprising two elongate air-knife discharge outlets—each outlet discharging a respective air-knife forwards onto a hand of the user—the air-knife discharge outlets are provided on a fixture in the form of a spout and are connected through the spout to an air supply, and the air-knife discharge outlets are arranged side-by-side over the basin of the sink, each air-knife outlet being arranged on an angle such that the inboard end the air-knife outlet is in front of the outboard end of the air-knife outlet.

2. The arrangement of claim 1, wherein the outlets additionally extend downwardly at an anhedral angle so that the inboard end of each air-knife discharge outlet is above the outboard end of the air-knife discharge outlet.

3. The arrangement of claim 1, wherein each air-knife discharge outlet comprises an elongate discharge aperture or elongate line of discharge apertures.

4. The arrangement of claim 1, wherein each air-knife discharge outlet comprises an elongate air slot or plurality of elongate air slots.

5. The arrangement of claim 4, wherein the width of the slot(s) is less than 2 mm.

6. The arrangement of claim 1, wherein each air-knife discharge outlet is at least 80 mm long.

7. The arrangement of claim 1, wherein the water faucet has a water delivery nozzle positioned in-between the two air-knife discharge outlets.

8. The arrangement of claim 7, wherein the water delivery nozzle and air-knife discharge outlets are provided on a single fixture that can be fitted next to the basin of the sink, the water delivery nozzle and air-knife discharge outlets each being provided on a projecting part of the fixture.

9. The arrangement of claim 7, wherein the water delivery nozzle and the air-knife discharge outlets are provided on a common projecting part of the fixture in the form of a spout.

10. The arrangement of claim 9, wherein the water delivery nozzle is connected through the spout to a water supply.

11. The arrangement of claim 1, wherein the air-knife discharge outlets are provided on branch ducts that branch off from a main air supply duct inside the spout, each air-knife discharge outlet extending along a sidewall of the respective branch duct.

12. The arrangement of claim 11, wherein the branch ducts are swept back at said angle relative to the spout.

* * * * *